United States Patent [19]

Heegaard

[11] 3,950,870

[45] Apr. 20, 1976

[54] PERSONAL PROPERTY IDENTIFICATION LABELS

[76] Inventor: John C. Heegaard, 4900 E. Sunnyslope Road, Minneapolis, Minn. 55424

[22] Filed: Oct. 15, 1973

[21] Appl. No.: 406,184

[52] U.S. Cl. ..... 40/2 R
[51] Int. Cl.[2] ..... A44C 3/00
[58] Field of Search ..... 40/2, 125 A, 2 R, 2.2; 283/6, 18; 206/56 AB, 460

[56] References Cited

UNITED STATES PATENTS

| | | | |
|---|---|---|---|
| 1,762,539 | 6/1930 | Adams | 156/520 |
| 2,213,666 | 9/1940 | Burke | 40/125 A X |
| 3,315,387 | 4/1967 | Heuser | 40/2 R |
| 3,552,853 | 1/1971 | Sanders et al. | 283/18 |
| 3,564,215 | 2/1971 | Peeples | 40/2.2 X |
| 3,571,957 | 3/1971 | Cumming | 40/2.2 |

FOREIGN PATENTS OR APPLICATIONS

| | | | |
|---|---|---|---|
| 1,014,894 | 12/1965 | United Kingdom | 40/125 X |

OTHER PUBLICATIONS

*Washington Post;* Mar. 12, 1964; p. D-15; "Steve Roper" comic strip.

*Primary Examiner*—Louis G. Mancene
*Assistant Examiner*—Wenceslao J. Contreras
*Attorney, Agent, or Firm*—Merchant, Gould, Smith, Edell, Welter & Schmidt

[57] ABSTRACT

Prepunched micro-indentification labels having an adhesive backing for application to articles of personal property as a deterrent to theft and as an aid in recovery of stolen property. A card containing a plurality of the labels is held against the article to be labeled and a label is punched out of the card so as to adhere to the article. Coded indicia too small to be read by the unaided eye is printed on the label to identify the owner of the property and his general location. A fluorescent agent added to the adhesive enables law enforcement authorities to find the labels on stolen property through the use of a black light.

7 Claims, 4 Drawing Figures

PERSONAL PROPERTY IDENTIFICATION LABELS

BACKGROUND OF THE INVENTION

The present invention pertains to micro-identification labels for affixing to personal property as a deterrent to theft, and as an aid to law enforcement authorities in identifying and recovering stolen goods.

Operation Identification, started in California ten years ago, is a program in which citizens mark their personal property do discourage thieves from stealing it. The citizens go to a police station and borrow an engraving tool to mark their property. Each citizen whoe does so is assigned a permanent identification number based on a code devised by the National Crime Information Center (NCIC) of the Federal Bureau of Investigation (FBI). An example of an NCIC number is MN-027-11-3-XXXXX, MN identifies the State of Minnesota, 027 identifies the County of Hennepin within the State of Minnesota, 11 identifies the City of Minneapolis within the County of Hennepin, and 3 identifies the third percinct within the City of Minneapolis. The XXXXX represents the permanent identification number of an individual citizen.

After the citizen is assigned a number and loaned on engraving tool he goes home, marks much of his personal property with this number (at least the types of things commonly stolen, e.g., cameras, stereos, etc.), makes a list of the marked property and puts the list in a safe place. Later if something is stolen the citizen calls the police and notifies them how it was marked.

Indentification programs such as this not only aid in the recovery of stolen property, but also serve as a deterrent to crime. Part of the deterrent effect comes from the fact that home owners registered under the program place a decal or sticker on their window warning a would-be burglar that the personal property inside the house is marked and registered. Another part of the deterrent effect comes from the fact that positive identification of goods as having been stolen makes it much easier to obtain a conviction of the thieves.

The present invention pertains to a program such as Operation Identification and provides significant improvements over the method of marking of property with an engraving tool. The present invention provides micro-identification labels which have identification numbers printed thereon. The labels are provided prepunched and preprinted in a card, and have adhesive material on the back thereof, for quick and easy attachment to items of personal property. The card is merely held against the item, and a punch is used to push a micro-identification label from the card into adherence of the item.

The labels are small enough so as to be inconspicuous so as to avoid discovery by a fast working thief. A fluorescent material mixed into the glue makes them very easy to spot by the authorities, through the use of a "black light". The printed numbers of the micro-identification labels are too small to be read with the unaided eye, but can easily be read with the assistance of a simple magnifying device. In the usual case, goods which are suspected as having been stolen are usually found in large quantities in a store or apartment. The police can then search each item under a black light for the micro-identification labels. The labels can be used instead of an engraving tool or in addition thereto.

Another advantage of the micro-identification labels is that their small size and ease of application makes them useful for marking items which cannot practically be marked by the engraving method. For example, the inside of the back cap of a wristwatch, and the bottom of a diamond in a ring can easily be marked through the use of the present invention.

SUMMARY OF THE INVENTION

The present invention comprises a card of microidentification labels containing printed identification indicia. In the preferred embodiment a microfilm process is used to print a sheet of labels. The labels are prepunched or perforated to facilitate separation. The sheet of labels is sandwiched between a pair of punched cards with the labels aligned with the punched out portions of the cards. A pressure sensitive adhesive is applied to the back surfaces of the labels. To label an article, the card is held against the article and a label is punched out of the card. As the label is punched out and contacts the article the adhesive on the back surface of the label contacts the article and causes it to stick to the article.

A fluorescent agent may be added to the adhesive or incorporated by means of the label printing process to facilitate the location of the label with black light.

DESCRIPTION OF THE PREFERRED EMBODIMENT

Figure 1:
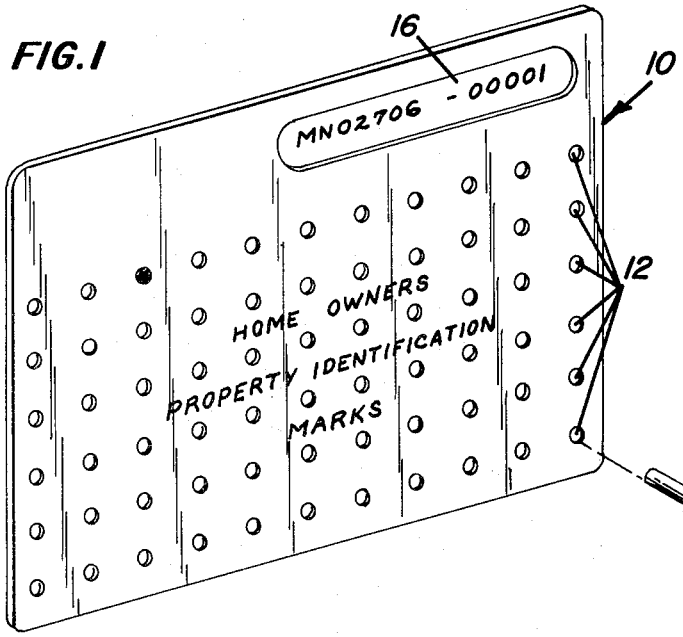
FIG. 1 is perspective view of a card containing a set of identification labels for affixing to personal property.

Referring to FIG. 1 the invention includes a card 10 containing a set of prepunched or perforated indentification tags or marks 12. A pressure-sensitive adhesive is placed on the backs of marks 12. To mark a piece of personal property the owner merely places card 10 against the article to be marked and presses or punches out a mark 12 with a dowel or punch 14. The adhesive on the back surface of mark 12 causes it to stick to the article as it is punched out.

Figure 2:
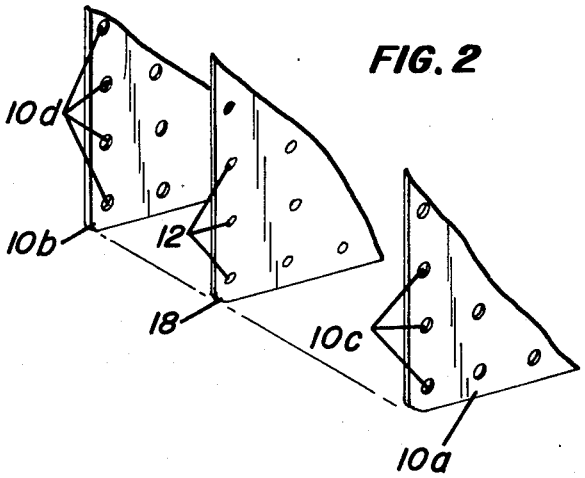
FIG. 2 is a partial perspective view of the card showing the construction thereof.

The construction of card 10, shown more clearly in FIG. 2, includes a front **10*a* and a back 10*b*, each of which contain aligned openings, such as round holes 10*c* and 10*d*. A sheet 18 containing printed micro-identification labels 12 is sandwiched between front 10*a* and backing plate 10*b*. A microfilming process may be used to print labels 12 on sheet 18, in which case the material of sheet 18 would be polyester, for example, Mylar. Labels 12 are aligned with openings 10*c* and 10*d*. Labels 12 are either perforated or prepunched as by scoring the Mylar sheet so that the labels will punch out easily. Front 10*a*, backing plate 10*b*, and sheet 18** are sandwiched together with adhesives to form an integrated card.

Figure 4:
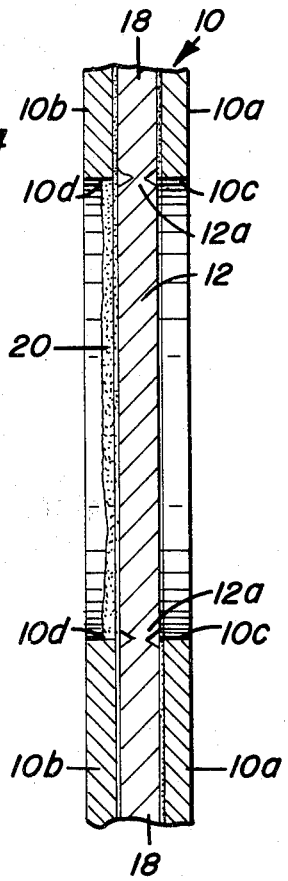
FIG. 4 is a sectional side view of a card showing the construction thereof.

The nature of the integrated card is shown more clearly in the sectional view of FIG. 4. In that FIG., **12*a* refers to the prepunched or perforated edge of a single micro-identification label 12. A pressure-sensitive adhesive 20 is applied to the back surface of label 12 through opening 10*d* in card back 10*b*.** H. B. Fuller Company, St. Paul, Minnesota, markets a pressure-sensitive adhesive (Stock No. 3648) which has been found to work well.

Figure 3:
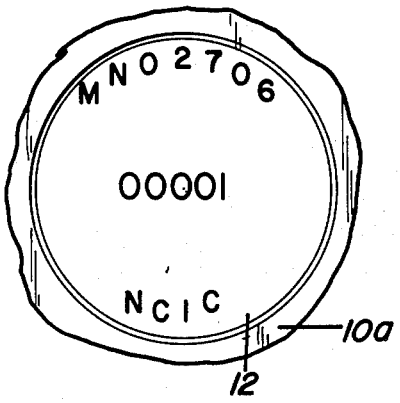
FIG. 3 is an example of a label showing the printing thereon.

An enlarged label 12 is shown on FIG. 3. Label 12 is very inconspicuous, the overall diameter is typically about 3/32 inch with the printed area having a diameter of less than 1/16 inch. While the label shown in FIG. 3 is circular, any desired shape could be used. Adding to the inconspicuousness is the clear or transparent background provided by sheet 18. The indicia printed on the upper portion of label 12 contains the alphanumeric MN02706 based on a code established for the nation by the National Crime Information Center (NCIC) of the Federal Bureau of Investigation (FBI). The alphabetic characters identify the state (in this case Minnesota), the first three numeric characters (027) identify the county (in this case Hennepin) within the state, and the last two characters (06) identify the city or village (in this case Edina) within the county. In large cities two more numeric characters may be used to identify a precinct within a city. The middle portion of the indicia contains a five-digit number which is assigned to an individual owner when he registers his property at the village or precinct police station. The bottom portion of the indicia contains the initials NCIC.

Other identifying indicia can be used in addition to or in place of the numbering system of FIG. 3. One alternate identification system comprises printing a reduced photographic reproduction of the property owner's thumb print on each microidentification label. Known techniques of fingerprint identification would lead to positive owner identification. Optionally, the thumb print could be combined with some identification numbers also.

Another alternate embodiment uses indicia printed on opaque paper of any color, for example, for sheet 18 and labels 12 of FIGS. 2 and 4, instead of a clear material such as polyester. The paper sheet would be scored and sandwiched as described above, and applied in the same manner. Since it would not be possible to see any fluorescent material mixed in the adhesive through the opaque paper base, a quantity of fluorescent material could be supplied in kit form along with each card of labels. By use of a suitable applicator, a small quantity of the fluorescent material could be smeared over and around the label after it is applied.

In one preferred embodiment of the present invention, backing sheets **10*a* and 10*b* are made of a farily flexible thin plastic material. This construction is preferred so that it is possible to bend the card as may be required to place a label on a small, curved, or otherwise difficult to reach place. However, if a large number of objects are to be labeled which have relatively large flat surfaces, the card can alternatively be made of a stiffer material, for ease of handling. In that case, front 10a and back 10*b* can be made of a thicker, stiffer plastic material. In addition, one of the backing sheets can be made with a lip so that the sheet 18** and the other backing sheet can fit snuggly inside the lip.

As stated above the micro-identification labels are very inconspicuous and difficult to see with the unaided human eye. This of course is an advantage in the sense that a thief can't remove what he doesn't notice. However, it is easy for the authorities to locate the mark because of the fluorescent material which may be mixed in with adhesive 20.

I claim:

1. A set of micro-identification labels for attachment to articles of personal property for indicating ownership thereof, comprising:

a. a member having a plurality of punchable labels thereon;

b. said labels preprinted with identification indicia small enough so as to be substantially unreadable with the unaided human eye;

c. a pressure-sensitive adhesive material applied to one surface of said labels;

d. means for mounting said member, said mounting means having a plurality of holes spaced for alignment with said labels; and e. means for attaching said member to said mounting means with said holes in alignment with said labels.

2. Micro-identification labels according to claim 1 wherein said member comprises a sheet having said labels thereon, and wherein said mounting means comprises a front and a back for sandwiching said sheet with holes in said front and back aligned with said labels.

3. Micro-identification labels according to claim 1 wherein said member is transparent and wherein said indicia for said labels are printed thereon with a microfilm process.

4. Micro-identification labels according to claim 3 wherein said pressure-sensitive adhesive material includes a fluorescent agent.

5. Micro-identification labels according to claim 1 wherein said indicia comprises an identification number which identifies the owner of the property to which the labels are applied, and a general location of the owner's residence.

6. Micro-identification labels according to claim 1 wherein said member is made of paper upon which said labels are printed.

7. Micro-identification labels according to claim 1 wherein said labels are scored or perforated for ease in removal from said member.

* * * * *